United States Patent [19]

Junkins

[11] 4,036,155

[45] July 19, 1977

[54] AUTOMATIC GUIDING APPARATUS FOR SEWING MACHINE

[76] Inventor: Ernest M. Junkins, 121 Wheeler Road, Monroe, Conn. 06468

[21] Appl. No.: 590,318

[22] Filed: June 25, 1975

Related U.S. Application Data

[62] Division of Ser. No. 850,950, Aug. 18, 1969, Pat. No. 3,683,831, and Ser. No. 280,107, Aug. 14, 1972, Pat. No. 3,901,172.

[51] Int. Cl.[2] ..... D05B 21/00; D05B 35/10

[52] U.S. Cl. ..... 112/121.15; 112/153

[58] Field of Search ..... 112/121.15, 121.12, 112/150, 153, 235, 236, 121.11, 262, 151

[56] References Cited

U.S. PATENT DOCUMENTS

| | | | |
|---|---|---|---|
| 51,547 | 12/1965 | Brown | 112/150 |
| 1,488,334 | 3/1924 | Frey | 112/121.15 |
| 2,142,476 | 1/1939 | McDonald | 112/121.12 |
| 2,672,833 | 3/1954 | Ritter | 112/235 X |

FOREIGN PATENT DOCUMENTS

| | | | |
|---|---|---|---|
| 1,201,829 | 8/1970 | United Kingdom | 112/121.15 |

*Primary Examiner*—Werner H. Schroeder
*Assistant Examiner*—Peter Nerbun

[57] ABSTRACT

An apparatus for guiding work past a sewing machine needle along a predetermined path to form a line of stitching corresponding to the path with deviations of the work from a normal feed path to the needle being sensed and causing a pivotal movement of the work about the needle to overcome the deviation. The ability of the apparatus to correct the deviation is related to the speed of sewing and to maintain this sewing speed within the deviation correcting ability there are fast and slow sewing speeds and sensing means that senses the occurrence of a large deviation and decreases the sewing speed to the slow speed to enable the apparatus to correct the deviation. For sewing a line of stitching a preselected distance from the edge of a workpiece, the vertical axis on which the work is pivoted is slightly tilted so that the workpiece is positioned to have the portion of its edge at the needle normally extend transversely beyond the needle a distance greater than the preselected distance from the needle. The edge of the workpiece engages the guide and is forced to be the preselected transverse distance from the needle. The apparatus utilizes a method when the work is two plies of cloth that are to be sewed together of holding the plies at a plurality of spaced points and feeding it at a determined rate while the feed dogs of the sewing machine are set to advance the cloth at a faster rate. The presser foot is made to exert only a light pressure on the cloth to permit slippage therebetween in order to minimize relative shifting and stretching of the two plies as they are sewn together with stitches having a stitch length determined by the rate of the apparatus.

7 Claims, 14 Drawing Figures

33
34
32
22
2
18
27
22
21
19a
21
13
35
24
26
25
15
30
19
14
29
28
31
23
17
16
38
20
22
73
12
36
37
20
40
39
43
41
73a
48
67a
45
D
42
A
49
54
53
62
59
58
45
65a
61
60
C
64
B
65b
46a
65
67b
63
45
2
10

AUTOMATIC GUIDING APPARATUS FOR SEWING MACHINE

This is a division of applications Ser. No. 850,950, now U.S. Pat. No. 3,683,831 and 280,107, now U.S. Pat. No. 3,901,172 filed Aug. 18, 1969 and Aug. 14, 1972, respectively.

In U.S. Pat. No. 3,170,423, assigned to the present inventor, there is disclosed a guiding apparatus that holds work to be sewed and moves the work along a path that corresponds to the desired line of stitching with the movement being along the normal feed path to the sewing machine needle. The path is set by the configuration of a cam and sensors engage the cam slightly in front of and behind the needle axis to detect if the cam is aligned with the normal feed path. If it deviates or if the path includes a curve which causes a response similar to a deviation, a motor effects pivoting of the cam and work about the needle to overcome the deviation.

The ability of the motor to correct the deviation is limited and if the speed of sewing, i.e. the speed of the work along the path of work is faster than the correcting ability, the path of the work will not conform to the normal feed path. However, if the sewing speed is made to be no greater than can be corrected for the maximum deviation that will occur on the path, the time for transversing the complete path will be less than the correcting ability of the apparatus on another portion of the path. This is unsatisfactory as it is desirable to form the line of stitching in the shortest possible time in order to fully utilize the capabilities of the apparatus.

In many sewing operations, a line of stitching is required to extend a set distance from the edge of a workpiece. One such operation is the run stitching of dress shirt cuffs where the set distance may be 1/16, 3/16, ⅛, ¼, etc, inches from the cuff edge. Another operation is the sewing of binding tape on the edge such as in sneaker tongues. The set distance or margin should be precisely maintained as it is normally visible and unevenness would detract from the appearance or functioning of the garment.

While there have heretofore been proposed machines for guiding cloth to form a desired line of stitching, such machines have not been found satisfactory in precisely maintaining the acceptable margin for the line of stitching. One difficulty has been caused by the inability to accurately place the work on a machine. Another problem has been caused by the edge of the workpiece not conforming to a predetermined contour and by the contour changing somewhat between workpieces. Accordingly, these difficulties have prevented heretofor known automatic guiding machines from forming acceptable lines of stitching with respect to an edge of a workpiece.

The above-noted patent sets forth that when the feed dogs of the sewing machine are operated during the sewing operation, the speed or rate at which the apparatus moves the work and the rate at which the feed dogs move the work have to be the same. Thus if the feed dogs are set, for example, at 15 stitches per inch, the apparatus feeds the work at a rate of 15 stitches per inch and the stitches formed in the work can only be at 15 stitches to the inch.

It has been found that when the feed dogs are used to control the rate at which stitches are formed to unite two or more plies of cloth, there is a tendency for the upper ply to be displaced with respect to the lower ply. The lower ply engages the feed dogs while the upper ply engages the stationary presser foot so that the movement of the upper ply is caused by the friction between the two plies while the presser foot exerts a restraint against the movement. As set forth in U.S. Pat. No. 3,368,507 this may result not only in displacement of the two plies, but an uneven tensioning of the plies which may give rise to the formation of a crimped or otherwise distorted seam.

It is accordingly an object of the present invention to provide an automatic guiding apparatus for use with a sewing machine to form a predetermined line of stitching in which the speed of the movement of the work past the needle is varied to decrease the time for forming the line of stitching.

Another object of the present invention is to achieve the above object with an apparatus in which the speed of sewing is governed by the ability of the apparatus to correct for a deviation of the path from the normal feed path to the sewing machine.

Still another object of the present invention is to achieve the above objects by continually sensing the extent of the deviation and altering the speed irrespective of whether the deviation occurs by reason of the shape of the path or by an extraneous unpredictable act.

A further object of the present invention is to provide a guiding apparatus for use with a sewing machine in which the speed of sewing is controlled by a structure that is simple in construction, durable in use, unaffected by changes in the shape of the predetermined path and which may be easily and economically incorporable into an apparatus.

Another object of the present invention to provide an automatic guiding apparatus which is capable of forming a line of stitching having a precise margin from the edge of a workpiece.

A further object of the present invention is to achieve the above object with an apparatus that will cause a satisfactory line of stitching even when the workpieces have contours that vary and are not accurately placed on the apparatus.

Still another object of the present invention is to provide an automatic guiding apparatus which is capable of forming a line of stitching having a precise margin from an edge which is relatively simple in design, durable in use and which requires only small alterations in heretofor suggested machines.

It is accordingly an object of the present invention to provide for the automatic feeding of cloth to a sewing machine in which relative displacement and shifting of the cloth plies relative to each other is substantially minimized.

Another object of the present invention is to achieve the above object with an apparatus in which there is essentially no mechanical change from heretofor-known apparatus.

A further object of the present invention is to provide a method of sewing two or more plies using an apparatus which automatically guides the cloth along the normal feed path to the sewing machine in which the rate of sewing or stitches per inch is determined by the apparatus rather than by the setting of the feed dogs.

In carrying out the present invention, the guiding apparatus includes a work holder that is capable of free universal movement so that it may move laterally, longitudinally and rotatably. The holder is mounted on one end of a vertical tube that in turn is rotatably supported by a work support which has free lateral and longitudinal movement while a cam is mounted on the other end of the tube. The cam has a periphery shaped to conform to substantially the predetermined path that is desired to be traversed and is engaged by a cam driving means only at a point that is aligned with the needle of the sewing machine so that the cam is peripherally moved by the cam driving means. Sensors engage the cam periphery on opposite sides, front and back, of the needle axis and sense if the cam portion therebetween is moving the work along the normal feed path to the sewing machine without substantial deviation. If the sensors sense the occurrence of a deviation, a correcting motor rotates the tube to cause the work holder to have a pivotal or rotational movement about the axis of the sewing machine needle with the work support accommodating any lateral and longitudinal movement caused by the tube's rotation. The tube is rotated until the deviation is overcome.

The correcting motor has a maximum rate at which it can rotate the tube to overcome the deviation within the time that is available for the work to pass from the forward sensor to the needle. The distance from the forward sensor to the needle axis is fixed at about 5/16 of an inch in one embodiment and the time for correction is thus essentially the time required, at the speed of the movement of the sewing machine to traverse this distance.

In accordance with the present invention, the deviation is not only sensed by the sensors which control the correcting motor, but is also sensed by a speed sensor which is utilized to control the speed of the sewing machine and the peripheral speed of the cam. Accordingly, when a deviation occurs that is greater than the correcting motor can overcome, the speed sensor effects shifting of the sewing machine and cam speed from a high rate to a low rate by appropriate clutching action. The sewing machine and cam will be driven at the low rate speed until the speed sensor detects that the deviation is again within the correcting motor's ability whereupon the sewing machine and cam are shifted to again operate at their high rate.

The speed sensor continuously engages the cam periphery in front of the front sensor to also be responsive to the extent of the deviation and hence will operate with most cam shapes, thereby eliminating the necessity for altering or otherwise providing on the cam, extra devices for controlling the speed. Moreover, extraneous factors which may cause an unpredictable, excessive deviation will also be sensed and cause the cam to be moved at a slow rate.

In further accordance with the present invention, the tube is altered so that it is not exactly vertical but is slightly inclined so that its bottom workpiece holding end is nearer the needle axis than its top cam carrying end. This causes the workpiece, at the needle, to extend transversely beyond the needle a distance which is the sum of the normal extension (with the tube vertical) plus the distance caused by inclination of the tube.

A guide is mounted on the sewing machine and has a surface which is spaced transversely of the needle a distance which is equal to the margin to be maintained. The workpiece edge engages the surface of the guide and is forced toward the workpiece holder so that the edge of the workpiece becomes spaced from the needle the same distance that the surface of the guide is spaced, thus insuring that the line of stitching will be this distance from the edge. As the workpiece is held by the workholder and as its edge is displaced toward the workholder, there is less distance between the workholder and the guide than there is portion of the workpiece, but this portion of the workpiece will buckle to accommodate the shortened distance.

In utilizing the present apparatus, the rate of feeding of the cloth is set by the apparatus and is the rate at which the stitches are formed. Additionally, the sewing machine feed dogs are also feeding the cloth, but at a rate which is faster than the rate at which the apparatus moves the work. However, to minimize the effect of the two different feed rates, the presser foot of the sewing machine is adjusted to exert only a very light force on the cloth. The force is sufficient to enable the feed dogs to move the cloth at the feed dog rate, if there is very little or no resistance but as the cloth is held by the apparatus, the feed dogs will only move the cloth until a slight tension develops whereupon slippage occurs between the cloth and the feed dogs. Furthermore, it will be understood that the basic factor for causing relative displacement, namely the friction between the presser foot and the top ply, is substantially minimized.

Other features and advantages will hereinafter appear.

Figure 1:
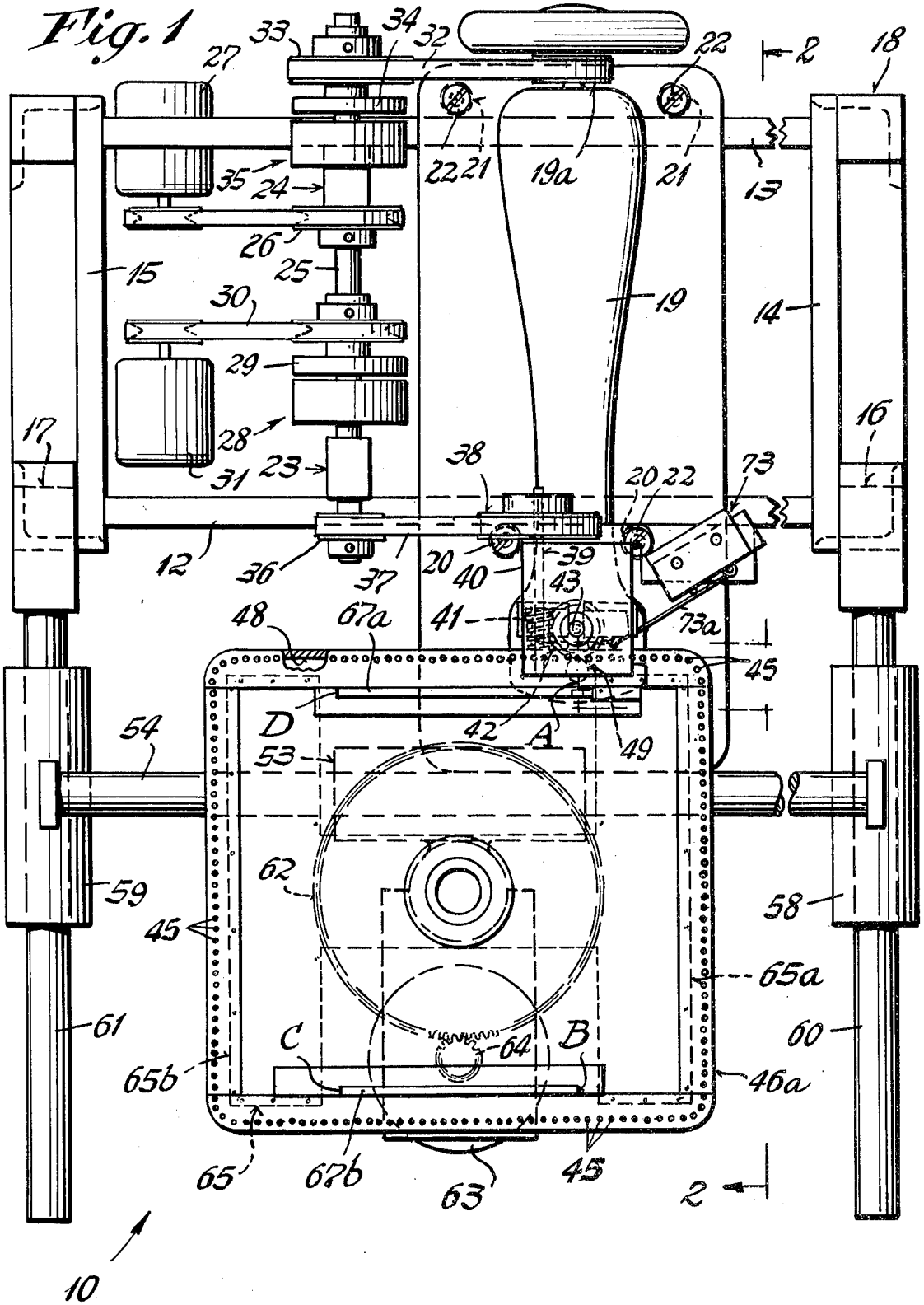
FIG. 1 is a plan view of the apparatus of the present invention.

Referring to the drawing, the automatic guiding apparatus is generally indicated by the reference numeral 10 and includes a base 11 which is a unitary weldment having two crosspieces 12 and 13, two longitudinal pieces 14 and 15 and a pair of upstanding posts 16 and 17. The weldment base 11 is secured on a four-legged stand 18 of conventional construction. A sewing machine 19 is mounted on front and rear pairs of pillars 20 and 21 that extend up from the crosspieces 12 and 13 respectively and is secured thereto as by screws 22.

Also secured to the crosspieces 12 and 13, to extend upwardly therefrom in back of the sewing machine, are uprights 23 and 24 respectively which are formed to have bearings that support a rotatable shaft 25. The shaft has a V-pulley 26 that is driven by a solenoid operated clutch-brake motor 27 of the type that is normally used in the apparel industry to drive sewing machines. Further, the shaft 25 has secured thereon an electric clutch 28 which includes a clutch member 29 mounted for free rotation on the shaft 25 and which is connected by a belt 30 to slow speed motor 31. The sewing machine pulley 19*a* is connected by a belt 32 to a pulley 33 that is fast on a clutch member 34 of another electric clutch 35. The member 34 is freely rotatable on the shaft 25 while the clutch is secured to the shaft.

It will thus be understood that the clutch brake motor 27 can rotate the shaft 25 at a fast speed and if the electric clutch 35 is energized, also drive the sewing machine at a speed determined by the speed of the clutch brake motor 27. The slow speed motor is continually operated but only drives the shaft 25 at a slow speed when the clutch 28 is energized and the clutch brake motor 27 is in neutral. Thus by operating the clutch 28 and the clutch brake motor 27, the speed of the shaft 25 and hence the sewing machine may be alternated between their two speeds and hence driven at a high or slow rate.

Figure 2:
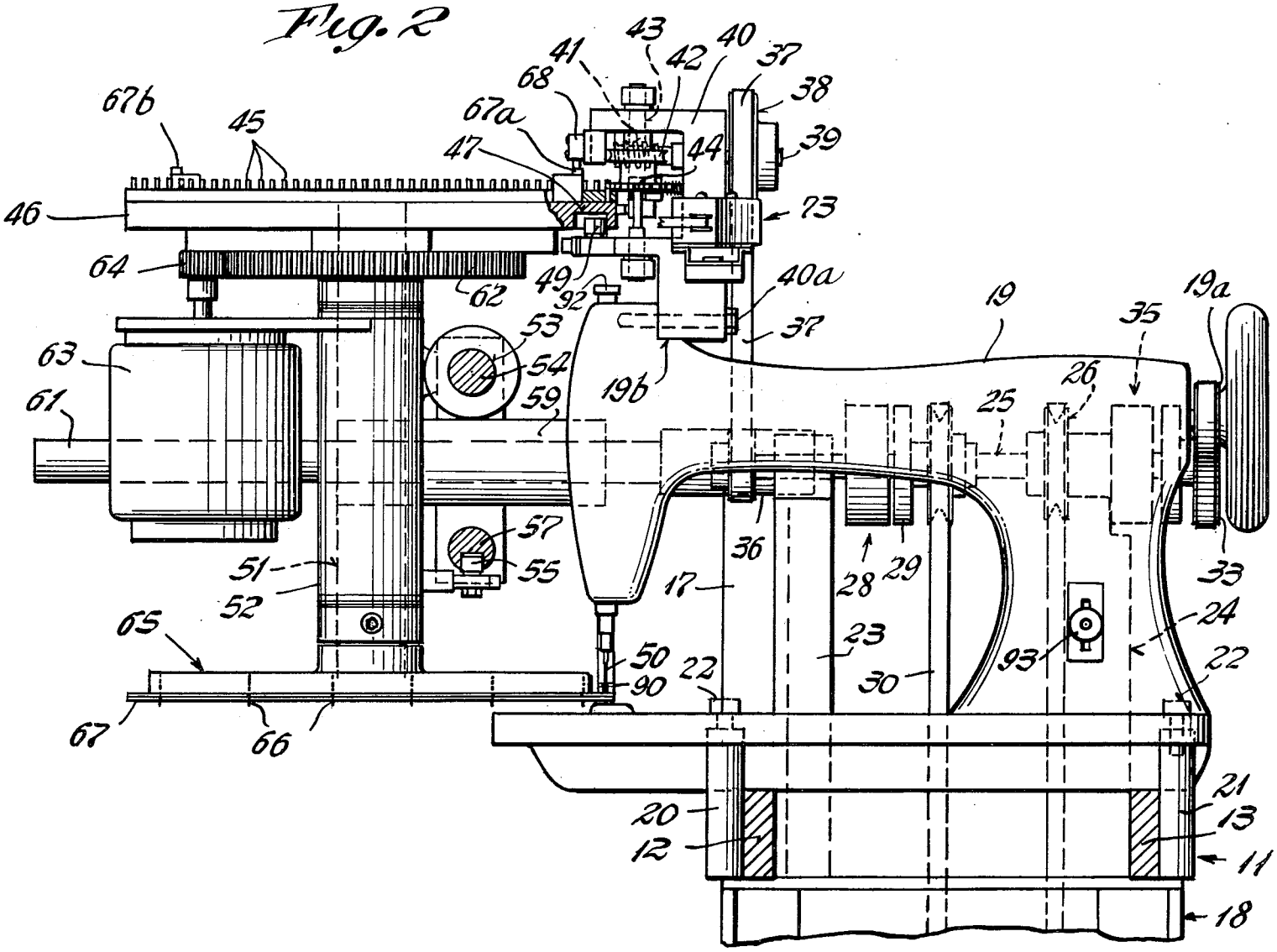
FIG. 2 is a front view thereof, partly in section taken on the line 2—2 of FIG. 1.

A pulley 36 is also fast on the shaft 25 and drives through a belt 37 and pulley 38, a shaft 39 that is mounted on a head 40. The head has the shape shown and is secured on the sewing machine in a cutout 19*b* machined in the sewing machine by bolts 40*a.* The shaft 39 carries a worm 41 which mates with a worm gear 42 (FIG. 2) that is secured on a vertical cross shaft 43. Also secured on the cross shaft 43 is a chain sprocket 44. The belts 32 and 37 are preferably timing belts so that one rotation of the sewing machine for producing a stitch will have a definite peripheral movement of the sprocket 44 which is essentially the stitch length of the stitches to be formed in the predetermined path.

The sprocket 44 positively engages pins 45 that extend uprightly from a cam 46. The cam is formed with a somewhat peripheral slot 47 on its undersurface with an inner surface 48 thereof being engaged by a cam follower 49 that is mounted on the head 40. The center line of the pins 45, which essentially simulate a roller chain, the inner surface 48, and the pitch diameter of the sprocket 44 are vertically aligned with the axis of a needle 50 of the sewing machine.

The cam 46 is mounted on the upper end of a tube 51 that is rotatably mounted in a support 52. The support 52 is mounted for free lateral movement back and forth of the sewing machine by a cross bore 53 containing, for example, ball bushings through which a cross rod 54 passes and a cam follower 55 that engages a groove 56 formed in another cross rod 57. The ends of the cross rods are supported in front and rear cross bearings 58 and 59 with each bearing including a bore, which may contain ball bushings and in which longitudinal rods 60 and 61 are positioned respectively. The front rod 60 is canterleverly one end supported by the post 16 while the rear rod 61 is similarly supported by one end being positioned within an aperture formed in the post 17. The cross bearings 58 and 59 are freely movable longitudinally on their respective rods as is the support 52 freely movable laterally on the cross rods 54 and 57 so that the rods hold the support 52 for free universal movement in a horizontal plane.

Positioned slightly below the cam 46 and secured to the tube 51 is a gear 62 that is driven by a motor 63 through a driver gear 64. The motor 63 is secured on the support 52 to move therewith and upon energization serves to rotate the tube 51.

The lower end of the tube 51 has secured thereon a flat plate work holder 65 having downwardly projecting pointed pins 66. Work 67 constituting flat pieces of fabric is held against the bottom surface of the plate 65 by the pins 66. The work may be transferred to the work holder plate 65 through the use of a transfer mechanism as shown in my U.S. Pat. No. 3,351,032.

The particular embodiment of the cam 46 shown is designed to form U-shaped lines of stitching in cuffs, such as shown in U.S. Pat. No. 3,170,423. Accordingly the plate 65 is somewhat H-shaped having a front part 65*a* and a rear part 65*b* with each part being similar and adapted to hold the cuff workpiece by the pins 66. The sewing of one cuff workpiece positioned on the part 65*a* is from a point A on the cam peripherally around to a point B while a cuff workpiece held by the portion 65*b* is sewed from approximately the point C peripherally around the cam to the point D. The movement of the cam between the points B and C and D and A is without the sewing machine being operated by rotating of the shaft 25 with the clutch 35 deenergized. The control of the clutch 35 is achieved by use of camming ridges 67*a* between the points A and D and ridge 67*b* between the points B and C which operate a switch 68 that is supported on the head 40 to engage the ridges. The switch 68 may also control thread cutting devices, presser foot, loading and unloading operations if desired.

For controlling the energization of the motor 63, which may be a stepping motor manufactured under the registered trade mark "SLO-SYN" by The Superior Electric Company, Bristol, Conn., there is provided a front sensor 69 and a rear sensor 70 as disclosed in the above-noted patent. The two sensors may be snap action switches (FIG. 3) having rollers 69*a* and 70*a* which are spring urged against the peripheral surface 46*a* of the cam 46. The switches are mounted on a block 71 which is supported for movement toward and away from the surface 46*a* on pins 72 that are secured in the head 40 and urged toward the surface 46*a* by springs 72*a.*

With the cam being moved in alignment with the normal feed path to the sewing machine both switch sensors 69 and 70 will be closed and the motor 63 deenergized. Upon a deviation occurring one of the switches will open, producing through a circuit shown in the above-noted U.S. patent, energization of the motor 63. As the motor 63 rotates the tube 51, the cam is caused to pivot or rotate about a center that is the line engagement between the cam follower 49 and the inner surface 48 and this is in alignment with the sewing machine needle. The rods permit and accommodate lateral and longitudinal movement of the work support as the cam is rotated. The motor will become deenergized when the deviation is overcome.

It will be understood that the inner surface 48 constitutes the predetermined path that the cam is to follow and that the peripheral surface 46*a* is identical thereto as to shape except that as it is formed on the opposite surface of a lip that depends from the cam so as to be slightly larger by the thickness of the lip.

When one of the straight sides of the cam is being engaged by the sensors 69 and 70, and a deviation occurs the motor 63 must correct it within the time that it takes for the cam to travel from the front roller 69*a* to the needle axis. This distance may be about 5/16 of an inch and a deviation to be corrected will amount to only a few degrees. The motor 63 in one embodiment of the invention has a speed of 72 RPM or 432° per second, the gearing of gears 64 and 62 is one to eight and hence the motor 63 can correct for 54° per sec. of deviation. The speed of the cam along its straight portions must be within the correcting ability of the motor and with the above numerical relationship may have a speed approximating 6 inches per second. On the other hand, for a 90° corner that exists between the two sides and which has a ½ inch radius curve, the correcting time for the motor is basically 90° divided by 54° or about 1.6 secs. The speed of the cam to travel the periphery of the corner must not be less than this time in order to maintain the presentation of the work to the needle along the normal feed path. Accordingly, the cam and sewing machine speed must be substantially reduced from the speed in which the straight sides are sewn. Though specific details have been recited concerning one embodiment, it will be appreciated that different motor speeds, cam shapes, and gear reductions may be employed in other embodiments but that the same problem of requiring at least two different speeds will be present.

In accordance with the present invention, the peripheral speed of the cam and the speed of the sewing machine is made to be governed by the extent of the deviation so that for small deviations the speed will be relatively fast, while for large deviation, the speed will be slow. Accordingly, there is provided a speed sensor 73 mounted on a bracket 74 secured on the head 40. The speed sensor is a normally open snap action switch having a lever arm 73*a* that engages the periphery 46*a* of the cam slightly ahead of the roller 69*a* of the front sensor 69. The switch is adjusted with respect to the periphery such that it is held closed when the cam has little or no deviation and opens when the deviation exceeds an amount for which the motor 63 cannot correct at the relatively fast speed.

Figure 3:
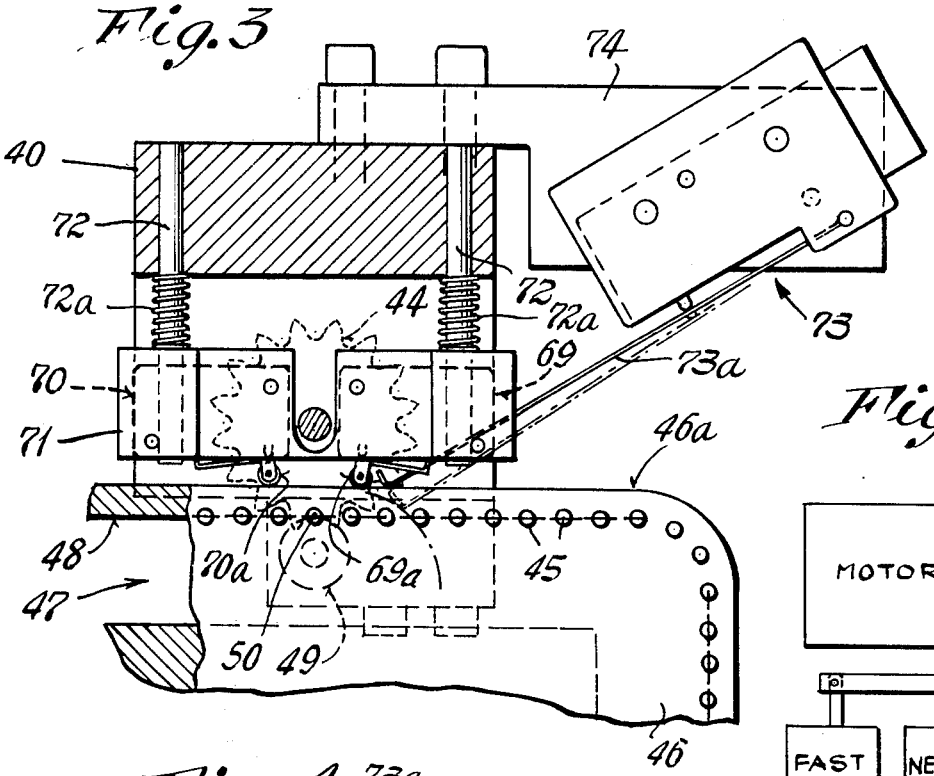
FIG. 3 is a sectional detail, essentially full size, of the portion of the cam and apparatus that is in alignment with the sewing machine needle axis.

Referring specifically to FIG. 3, the two deviation sensors 69 and 70 are shown along with other portions of the cam including the pins 45 and cam follower 49. The lever arm 73*c* of the speed sensor 73 is shown in solid line at its position where it causes the sensor 73 to be closed by reason of the cam periphery 46*a* being essentially in alignment with the normal feed path without substantial deviation. As a curved corner of the predetermined path approaches the needle axis (shown in dotted lines in this figure), the sensor 73 will assume its normally open position (shown in dotted lines) as the cam periphery no longer bears against the arms 73*a* to maintain the sensor closed. The sensor 73 will maintain its open condition as long as there is no portion of the cam which is capable of forcing the lever arm to its closed position and thus the sensor 73 will be at its open condition for essentially all the time that the corner is being sewed. At the end of the corner, the subsequent straight side of the cam will engage the lever arm to force the sensor to assume its closed position. The closed position of the speed sensor switch effects a fast rate of cam travel while the open position causes a slow rate of travel.

Figure 5:
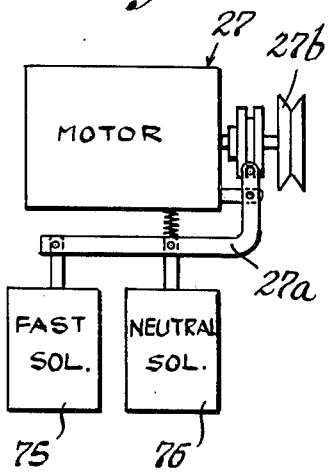
FIG. 5 is a diagrammatic representation of a solenoid operated clutch brake motor which is used in the present invention.

As shown in FIG. 5, the clutch brake motor 27 has a fast solenoid 75 connected to a lever arm 27*a* and a neutral solenoid 76 also connected thereto. Energization of the fast solenoid 75 pulls the lever 27*a* such that the clutch engages the motor to drive the pulley 27*b* at the speed of the clutch brake motor in the same manner that is normally effected by a sewing machine operator using a treadle. The neutral solenoid 76 when energized also pulls the lever 27*a,* but just a short distance, sufficient to release the spring urged brake. Thus, the the pulley 27*b* to be braked, both solenoids are deenergized; for neutral just solenoid 76 is energized and for fast speed at least solenoid 75 and usually solenoid 76 are both energized.

Figure 6:
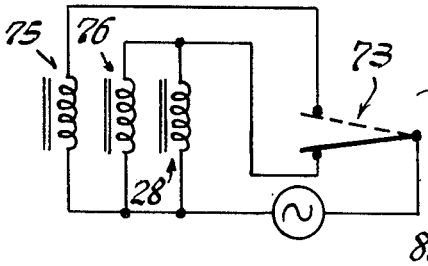
FIG. 6 is an electrical schematic diagram.

Referring to the schematic drawing, FIG. 6, the fast solenoid 75, neutral solenoid 76 and electric clutch 28 are depicted together with their connections to the sensor switch 73. In the closed condition of the sensor 73, indicating that there is no more than a small deviation, the fast solenoid is energized by the switch being in its dotted line position, driving the sewing machine and the cam at a relatively fast speed as for example 4 in. per second of cam peripheral speed which is within the correcting ability of the motor 63. Upon the occurrence of a corner or whenever sensor 73 assumes its normally open condition, the fast solenoid 75 is deenergized and the neutral solenoid 76 and clutch 28 are energized. This causes the slow speed motor 31 to drive the shaft 25 while the clutch brake motor 27 is in neutral, being neither braked nor driven. Preferably, the speed of the slow speed motor is such that it takes substantially as long for the corner to be traversed as the correcting motor 63 requires to correct for the deviation produced by the corner. If the speed is slightly less than this, the correcting motor will have short intervals of deenergization while, if longer, there tends to be a flaring of the stitching and not a true arc.

Figure 4:
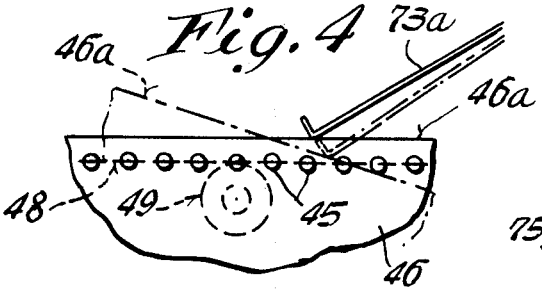
FIG. 4 is a diagrammatic representation of the operation of the speed sensor.

Shown in FIG. 4 is a diagrammatic representation of the speed sensor 73 and a straight portion of the cam. The solid line position is the normal, little or no deviation position of the cam and the sensor 73 effects a fast speed, while the dotted line position of the cam 73*a* occurs with a large deviation and the sensor effects a slow speed. The dotted line position does not normally occur but could by some extraneous unpredictable event. Also, while a straight position of the cam is shown, it could also be an arc or curve of larger radius than the described cam corners. Thus the speed sensor 73 by continuously engaging the portion of the cam that corresponds to the predetermined path will continuously monitor the extent of the deviation and control the speed with respect to the extent of the deviation.

Figure 7:
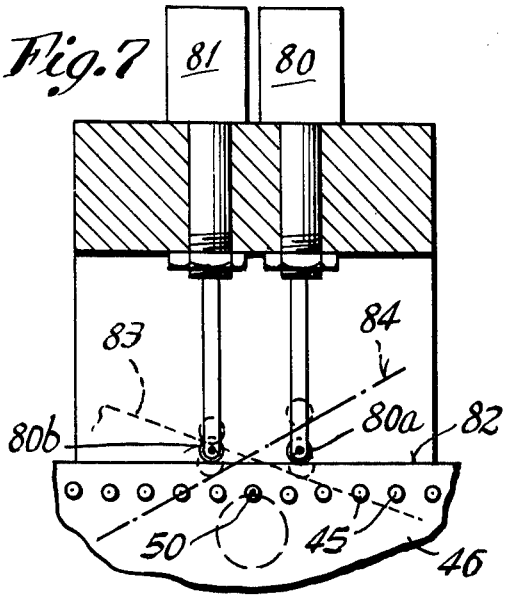
FIG. 7 is a further embodiment of the present invention which enables sensing a deviation which may occur in either direction.
Figure 8:
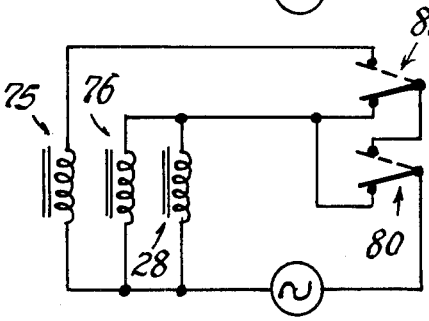
FIG. 8 is an electrical schematic diagram usable with the embodiment shown in FIG. 7.

While in the embodiment of the invention hereinbefore described, there has been just one sensor 73 for controlling the speed in view of the cam having concave curves, if desired, as shown in FIGS. 7 and 8, the speed may be controlled for deviation in both directions. As diagrammatically shown in FIG. 7, there is a forward speed sensor 80 and a rearward speed sensor 81, mounted on the head 40 to have rollers 80*a* and 81*a* on either side of the needle axis 50 to bear against the cam periphery. Both sensors 80 and 81 are normally open switches and have their rollers spring-urged outwardly toward the cam periphery. When the portion of the cam 46 that is sensed is along the solid line 82 indicating little or no deviation, both switches will be closed to energize the fast solenoid 75 by the circuit shown in FIG. 8. When the cam has a deviation indicated by the dotted line 83, the switch 80 becomes open, to assume its solid line position, deenergizing the fast solenoid 75 and energizing the neutral solenoid and the clutch 28 to operate the cam at a slow speed. When the cam has a deviation position as depicted by the dotted line 84, the switch 81 opens while the switch 80 remains closed and again the neutral solenoid 76 and clutch 28 are energized, driving the cam and sewing machine at a slow speed. While straight lines 83 and 84 are shown in depicting the cam in various positions, the cam could also be curved to achieve the same operation of the switches if they produce sufficient deviation. Thus the same switches may be utilized with different shaped cams.

Figure 14:
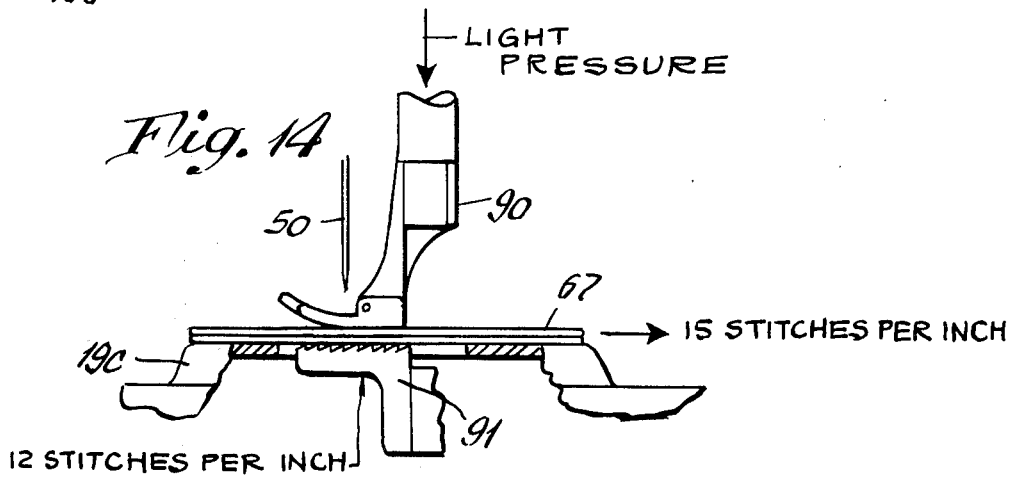
FIG. 14 is a representation of the feeding with the different rates being shown and, also, the presser foot tension.

The above specifically disclosed embodiment is capable of forming the initial joining operation of three plies of work 67 of a cuff, an operation commonly called cuff run stitching. As shown in FIG. 14, a presser foot 90 is employed and is adjusted to exert only a very light tension or pressure onto the feed dogs 91 with the work being positioned therebetween. The sewing machine includes the usual spring (not shown) for urging the pressure foot downwardly and the tension adjustment is by a conventional thumb nut 92 located above the presser foot. Additionally, the sewing machine has an adjusting mechanism 93 for controlling the feed rate of the feed dogs. The feed dogs and the presser foot may have the same construction that would be used if the work was to be manually guided to the sewing machine.

For minimizing the shifting and stitching of the plies as they are sewn, the rate at which the cam 46 is moved is different than the rate at which the feed dogs are adjusted. The latter is set to move the work at a faster rate which may be on the order of 5–30% greater than the cam rate. In one embodiment of the invention when it was desired to have 15 stitches per inch in the work 67, the cam rate was set to move at a rate of 1/15% of an inch for each needle reciprocation while the rate of the feed dogs was adjusted to 12 stitches per inch. Further, as shown in FIG. 14, the presser foot had an extremely light tension.

The tension of the presser foot as adjusted by the nut 92 is sufficient to cause the feed dogs to move the work, if there is little or no resistance to movement. By simply positioning work thereat, free from the holder 65, and turning the sewing machine by hand, the stitches' length at which the feed dogs are set to move the work may be selected. It has been found that as the tension of the presser foot is increased, the feed dog rate has to decrease toward the cam rate and conversely, the lesser the feed dog rate, the greater may be the difference.

Figure 13:
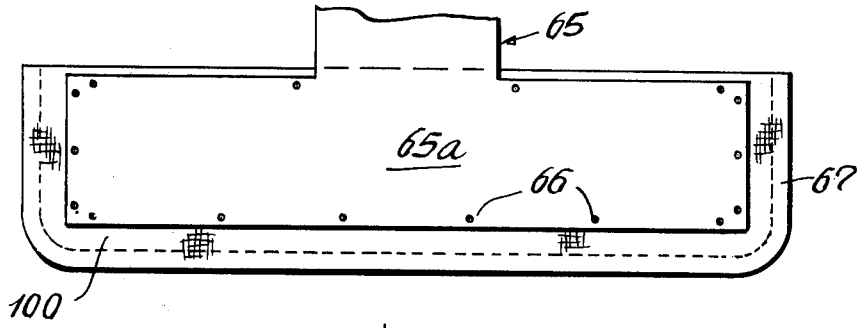
FIG. 13 is a representation similar to FIG. 12 showing a pair of plies to be sewed together.

It will be understood that the pins 66 are spaced about the holder 65 and continually penetrate the work so that except for the start and finish of the line of stitching, the work is held by pins both in front and in back of the needle. Also, the pins, in one embodiment, are spaced about ½ inch from where the line of stitching is formed and may have a spacing along the line of stitching such as is shown in FIG. 13.

The rate of cam movement is fixed by the rates between the pulleys 32 and **19*a* and between the pulleys 36 and 38 taken in conjunction with the sprocket 44 pitch diameter and the reduction between the worm 41 and worm gear 42. The belts 32 and 37** are tooth belts, sometimes called timing belts, as are their associated pulleys, so that the drive to both the cam and the sewing machine is positioned without slippage. The pulley ratios are selected so that one revolution of the sewing machine produces a pitch diameter peripheral movement of the sprocket which is a length equal to the reciprocal of the number of stitches per inch desired and the cam is thus forced to have this movement for each stitch. Also, by changing the pulley ratios, a different number of stitches per inch may be attained.

Figure 12:
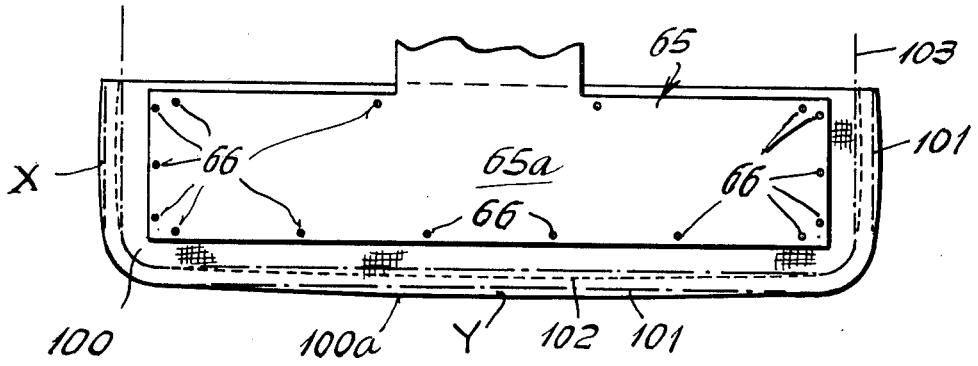
FIG. 12 is a representation of various edges and paths.

The above described apparatus and method is used to provide for cuff run stitching. After such stitching or with creased cuffs, the cuff is inverted and a line of stitching called top stitching is applied. Referring to FIG. 12, there is shown the holder 65 and a cuff 100 which has been stitched, and then inverted. Adjacent the edge **100*a* of the cuff 100 is a dot-dash line 101 which corresponds to the line of run stitching and would be the normal shape of the cuff. However, the inverting operation causes side deviations indicated by the letter X and a front deviation indicated by the letter Y. The extent of the deviations may be 1/32 or 1/16 of an inch and are not exactly predictable. A line of stitching indicated by the dotted line 102 is desired to be sewn onto the cuff to be a precise margin such as 3/16, from the edge of the cuff. The inner surface 48 of the slot 47 in the cam 46, which is the predetermined path that the workholder will move the cuff 100 with respect to the sewing machine needle, is indicated by the line 103 and its shape corresponds to the normal shape 101 of the cuff less the precise margin. The outer periphery of the holder 65*a* is spaced about ½ to ⅝ of an inch from where the line of stitching 102** is to be formed.

In accordance with the present invention, the line of stitching 102 is formed to be precisely set in from the edge of the cuff even though the cuff is moved along a predetermined path 103 that does not correspond to the line of stitching 102 and even though the true outline of the cuff is not exactly predictable. This is achieved by tilting the axis of the tube 51 slightly from the vertical so that its lower workpiece holding end is positioned nearer the needle than the cam carrying end. Preferably, the tilting of the tube 51 is effected by mounting the cam follower 55 on a block **55*a* that is bolted to the support 52 and shortening the width of the block. In one embodiment, the width of the block 55*a*** was made to cause the workpiece holder to be about ⅛ of an inch nearer the needle than if it has been exactly vertical.

Figure 9:
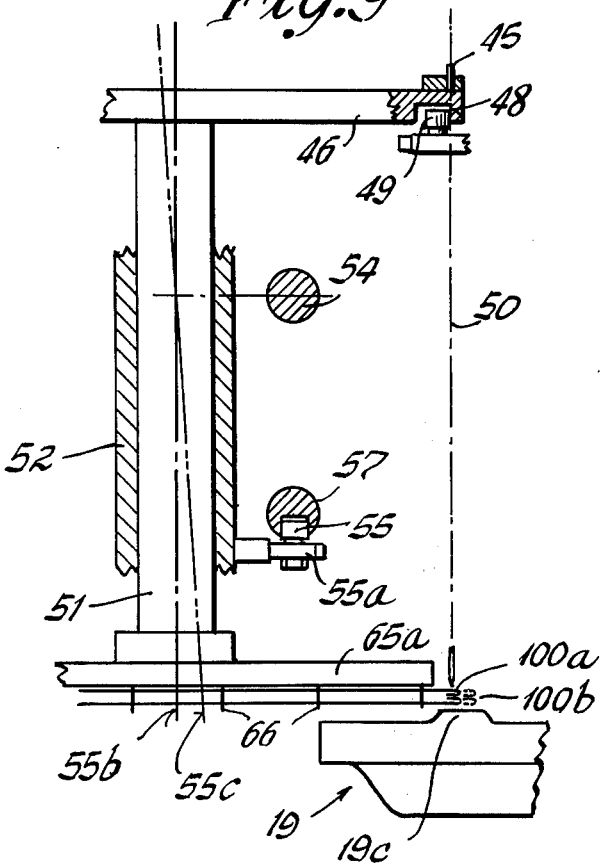
FIG. 9 is a diagrammatic representation of the inclination of the tube with respect to the needle.

Referring to FIG. 9, there are depicted the various heretofore mentioned parts including a vertical needle axle 50, a vertical tube axis **51*a* and a tilted tube axis 51*b*. Also depicted is a portion of the sewing machine 19 which has a somewhat raised throat plate 19*c* (or a portion of the bed may be cut away) to enable the ends of the pins to extend slightly below the surface where the cloth is supported at the needle. The tilting of the axis causes the cuff edge 100*a* to be positioned as shown at 100*b* at the needle while it should be positioned at the solid line location 100*a*** to cause the precise margin to be formed.

Figure 11:
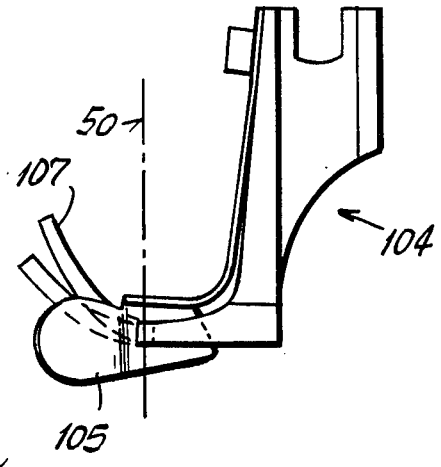
FIG. 11 is a side view of one embodiment of a presser foot having an edge guide.

The sewing machine has a presser foot 104, shown in FIG. 11, having an edge guide 105 that is spaced the precise margin from the needle that the line of stitching 102 is to be spaced from the edge **100*a* of the cuff. During the sewing operation, the cuff edge will attempt to assume the position 100*b* in the area of the needle axis, but it will engage the guide 105 thereat and be forced leftwardly until it is spaced the precise distance required for the margin. The cuff is held by the pins and the leftward movement of the edge will be accommodated by the cuff material buckling between the workholder 65 and the guide 105 as indicated by the reference numeral 106 in FIG. 10. The presser foot maintains the edge portion of the cuff flat between the guide 105** and the needle to prevent buckling thereat.

Figure 10:
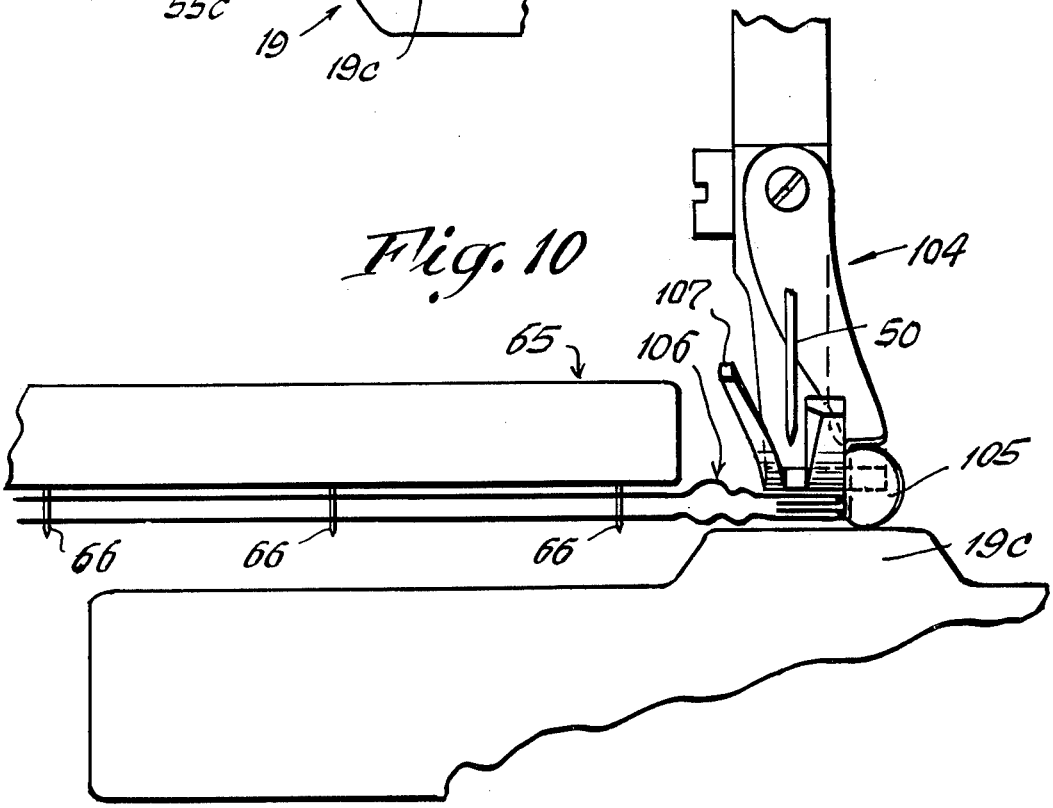
FIG. 10 is a section, taken in a vertical plane in front of the needle axis and transverse to the normal feed path, somewhat enlarged.

Preferably, as shown in FIGS. 10 and 11, the outer toe 107 of the presser foot is bent outwardly and upwardly to guide downwardly the cuff edge prior to the needle. While a specific embodiment of guide has been shown, other guides of different construction may be utilized if desired.

In addition to enabling the precise margin the be effected, the use of the guide also enables the cuff 100 to be placed on the holder 65, somewhat askew, which reduces the precision necessary for loading the cuff on the apparatus.

It will thus be understood that there has been disclosed an apparatus for guiding work past a sewing machine needle to form a predetermined line of stitching in the work. A cam is shaped to have the predetermined path and is peripherally moved along the path so that it presents the work to the sewing machine along the normal feed path. When a deviation occurs, it is sensed and a motor overcomes the deviation. In addition, in order to increase the utilization of the apparatus by quickening the time for traversing the path and sewing the work, the extent of the deviation is continuously monitored and if it exceeds a predetermined amount, then the cam and sewing machine speed are descreased until the deviation is reduced. Thus the work may be sewed whenever slight or no deviaion exists at a relatively fast pace but reduced when excessive deviation occurs to always be within the capabilities of the apparatus to correct the deviation. Additionally, the apparatus may be simply and easily adjusted to form a line of stitching a precise margin from the edge of a workpiece even though the shape of the edges is not exactly predictable. This is accomplished by causing the edge of the workpiece at the needle to try to be located beyond the precise margin but to force it back to the precise margin with the extent of the collapsing being dependent on the extent of the deviation.

As the apparatus feeds the work in a direction which is along the normal feed path to the sewing machine, the feed dogs are also used to move the work. However, the rate at which the feed dogs could move the work is made to be faster than the rate at which the apparatus moves the work. As only a light tension is exerted by the presser foot urging the work against the feed dogs, the difference in the feed rates is overcome by slippage between the work and the feed dogs and the stitch length of the stitches in the line of stitching is set by the feed rate of the apparatus. Accordingly, relative shifting and/or stretching of the plies of the work with respect to each other is minimized, producing a more satisfactory seam.

Variations and modifications may be made within the scope of the claims and portions of the improvements may be used without others.

I claim:

1. An apparatus for guiding work along a predetermined path with respect to a sewing machine having a needle to form a line of stitching substantially corresponding to the path and positioned a precise margin from the edge of the work comprising a work holder for holding the work, drive means for causing the work holder to move the work at the needle along the normal feed path to the needle, means for supporting the work holder to normally space the edge of the work at the needle transversely beyond the needle a distance that is greater than the precise margin and guide means having a surface spaced transversely of the needle by a distance equal to the precise margin and engageable by the edge of the workpiece to force the edge to a distance transversely of the needle that corresponds to the precise desired margin.

2. The invention as defined in claim 1 in which the work holder supporting means includes a member rotatable about an axis and means for inclining the axis of the rotatable member towards the needle.

3. The invention as defined in claim 2 in which the drive means includes a cam mounted on the rotatable member and in which the cam is shaped to provide the predetermined path which the work holder moves.

4. The invention as defined in claim 1 in which the work holder holds the work at the needle a distance which is less than the width of the portion of the work between the needle and the holder whereby the portion is caused to buckle to accommodate the difference.

5. A method of forming a line of stitching by a sewing machine having a needle with the line of stitching being located a precise margin from the edge of the work comprising the steps of moving the work along a predetermined path which substantially corresponds to the desired line of stitching, normally positioning the edge of the work at the needle beyond the needle a distance which is greater than the precise margin and forcing the edge at the needle transversely of the needle to a location where the edge is the precise margin from the needle.

6. The invention as defined in claim 5 in which the step of moving includes the step of holding the work at the needle a distance from the needle which is less than the width of work between the holding and the needle and permitting the width of the work to buckle to accommodate the difference.

7. The invention as defined in claim 5 in which the work is moved along a path that does not correspond exactly to the line of stitching formed in the work.

* * * * *